United States Patent [19]

Neidich

[11] Patent Number: 4,545,638

[45] Date of Patent: Oct. 8, 1985

[54] RIB CAGE TERMINAL

[75] Inventor: Douglas A. Neidich, Harrisburg, Pa.

[73] Assignee: E. I. Du Pont de Nemours and Company, Wilmington, Del.

[21] Appl. No.: 390,510

[22] Filed: Jun. 21, 1982

[51] Int. Cl.[4] ..... H01R 13/02

[52] U.S. Cl. ..... 339/205; 339/258 RR

[58] Field of Search ..... 339/258 RR, 262 RR, 339/205, 256 R, 256 B, 258 R, 258 A

[56] References Cited

U.S. PATENT DOCUMENTS

| | | | |
|---|---|---|---|
| 2,499,297 | 2/1950 | Buchanan | 339/205 |
| 3,183,471 | 5/1965 | Burkert | 339/258 RR |
| 3,409,863 | 11/1968 | Culver | 339/258 RR |
| 3,763,460 | 10/1973 | Hatschek et al. | 339/89 |
| 4,445,747 | 5/1984 | Neidich | 339/258 RR X |

FOREIGN PATENT DOCUMENTS

| | | | |
|---|---|---|---|
| 365003 | 12/1981 | Austria | 339/258 RR |
| 343712 | 11/1921 | Fed. Rep. of Germany | 339/258 RR |
| 819266 | 10/1951 | Fed. Rep. of Germany | 339/258 RR |
| 965506 | 6/1957 | Fed. Rep. of Germany | 339/258 RR |
| 1023107 | 1/1958 | Fed. Rep. of Germany | 339/258 RR |
| 1465682 | 4/1969 | Fed. Rep. of Germany | 339/258 RR |
| 2148805 | 4/1973 | Fed. Rep. of Germany | 339/258 RR |
| 2224851 | 12/1973 | Fed. Rep. of Germany | 339/258 RR |
| 2615820 | 10/1977 | Fed. Rep. of Germany | 339/258 RR |
| 2708753 | 9/1978 | Fed. Rep. of Germany | 339/258 RR |
| 811272 | 4/1937 | France | 339/258 RR |
| 960968 | 11/1949 | France | 339/258 RR |
| 1009831 | 3/1952 | France | 339/258 RR |
| 1319621 | 1/1963 | France | 339/258 RR |
| 357101 | 11/1961 | Switzerland | 339/258 RR |
| 378967 | 8/1964 | Switzerland | 339/258 RR |
| 239345 | 9/1925 | United Kingdom | 339/258 RR |
| 684143 | 12/1952 | United Kingdom | 339/258 RR |
| 993266 | 5/1965 | United Kingdom | 339/258 RR |
| 1000223 | 8/1965 | United Kingdom | 339/258 RR |
| 1153508 | 5/1969 | United Kingdom | 339/258 RR |
| 377930 | 7/1973 | U.S.S.R. | 339/258 RR |

*Primary Examiner*—William R. Briggs

[57] ABSTRACT

A female electrical terminal for receiving round or square pins having at least one rib cage mounted on one end of a spine. The rib cage has at least two pair of curved cantilevered beams attached at one end to the spine and forming an acute angle with the spine.

9 Claims, 13 Drawing Figures

RIB CAGE TERMINAL

DESCRIPTION

1. Technical Field

This invention relates to electrical connectors. More particularly, it refers to a rib cage terminal for use in connecting to round or square pins.

2. Background Art

The prior art is replete with descriptions of terminals used to contact square or round pins. Many of these terminals are effective for their intended purpose. Examples of these terminals can be found in French Pat. No. 960,968 and U.S. Pat. Nos. 2,758,291, 3,538,340 and 3,763,460. However, the search continues for improved terminals that are effective and low cost.

SUMMARY OF THE INVENTION

I have designed a novel low cost female terminal, extremely effective for contacting round or square pins. My terminal has an electrically conducting rib cage mounted on one end of a spine and another electrically conducting device such as a second rib cage on the other end of the spine. The two rib cages are separated by a mid-portion of the spine. The rib cages have at least two pair of ribs in the form of curved cantilevered beams, each beam attached at one end to the spine and spaced apart at its other end from a corresponding beam. Each beam is at an acute angle with respect to the center of the spine. The diameter of the rib cage is sufficient to receive a round or square pin from another electrical device. The spine also has mounting tabs at each end extending in a direction away from the rib cages.

BRIEF DESCRIPTION OF THE DRAWINGS

The present invention may be best understood by those having ordinary skill in the art by reference to the following detailed description when considered in conjunction with the accompanying drawings in which.

DETAILED DESCRIPTION OF THE PREFERRED EMBODIMENT

Figure 1:
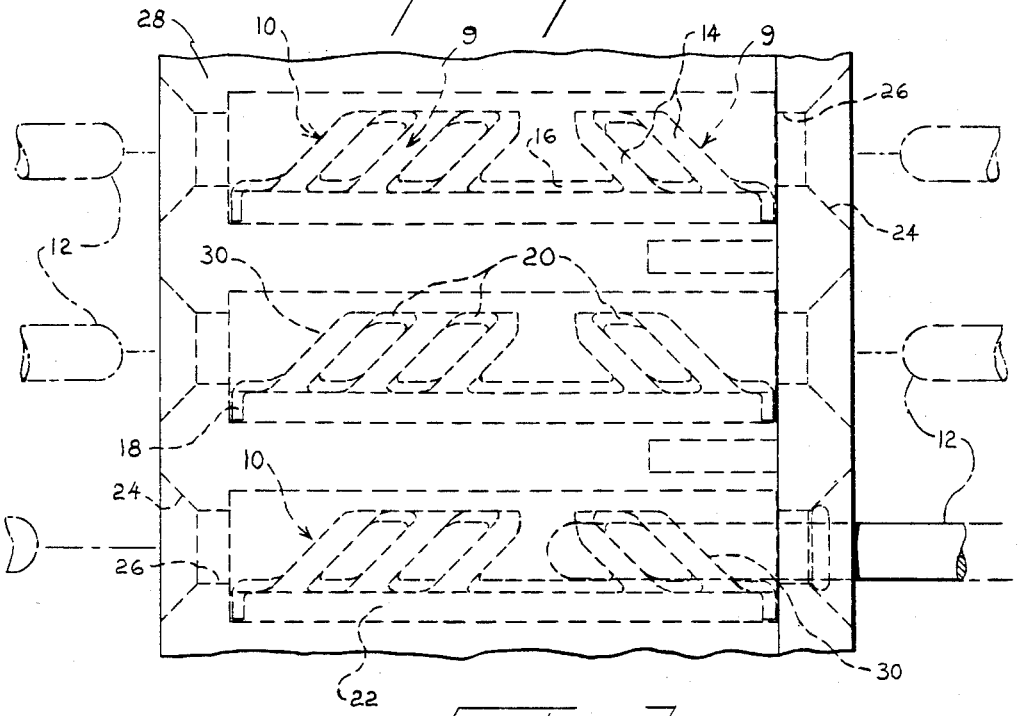
FIG. 1 shows a cutaway in phantom of three rib cage terminals mounted in a connector housing with connecting pins either inserted or ready for insertion.

Referring to FIG. 1 there is shown a rib cage terminal 10 mounted in a housing 28. A pin 12 is shown ready for insertion into the rib cage terminal 10. Ribs 14 in the rib cage 9 form an acute angle with regard to the spine 16 of the terminal 10. The bridging mid-portion 11 of the spine 16 separates two sets of rib cages 9. Mounting tab 18 assists in maintaining the position of the terminal 10 within the housing 28. Slots 19 separate the ribs. A rib bridge 20 separates the top of each rib 14. The sloped terminal face 30 of the rib 14 receives the terminal pin 12 after the pin has passed through the opening or pin channel 26 in the housing. Chamfered edges 24 in the housing 28 maintain easy entry of the pin 12. A central opening 22 within the inside space of the rib cage 9 receives the pin 12. The pin is of such a diameter as to slightly spread the ribs 14 during insertion. The ribs 14 contract after withdrawal of the pin 12.

Figure 2:
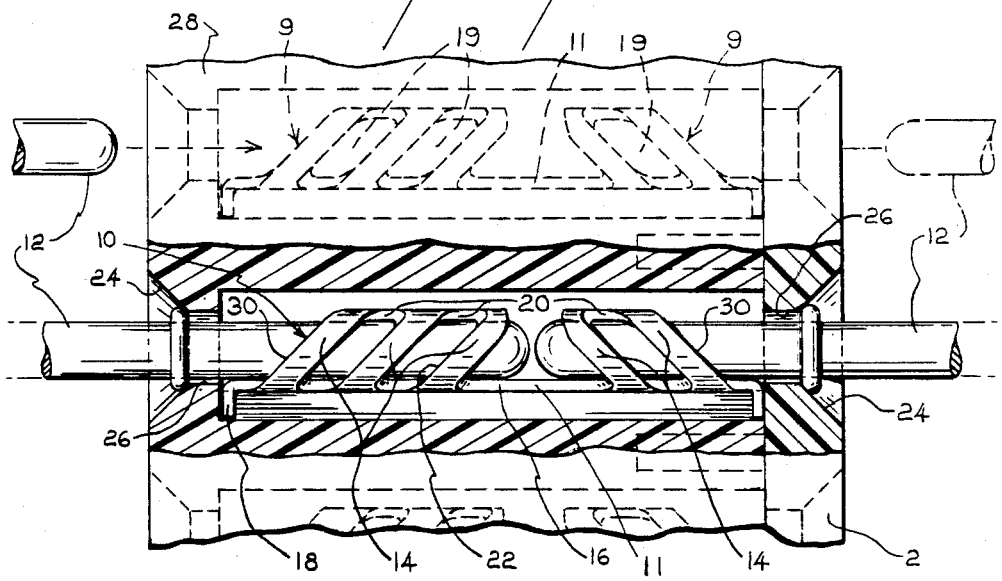
FIG. 2 shows a section through a connector housing exposing a rib cage terminal with connecting round pins inserted.
Figure 5:
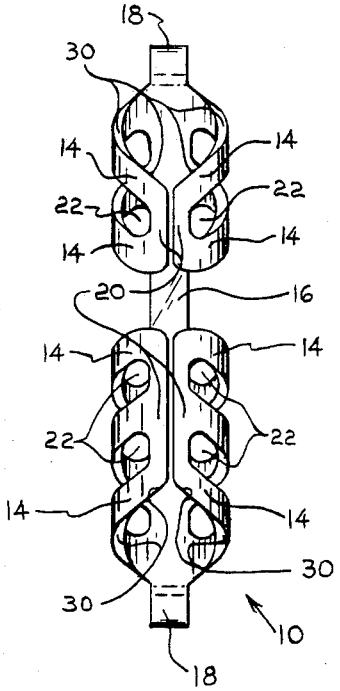
FIG. 5 is a top view of the rib cage terminal showing two rib cages.
Figure 6:
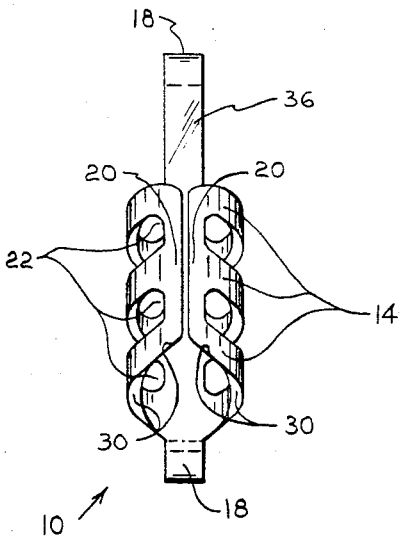
FIG. 6 is a top view of the rib cage terminal showing a solder tab as the other electrically conducting body.

In FIG. 2 separate pins 12 are inserted from each end of the terminal 10 so that each pin penetrates into the central opening 22 of each rib cage 9. Since the rib cage 9 on the right hand side has only two of the cantilevered beams or ribs 14, the pin on the right side can be removed with less force than the pin on the left side which must be removed from a rib cage 9 having three pairs of ribs 14. As can be seen in FIGS. 3(B), 5 and 6, the ribs 14 are curved from the spine 16 in an upward direction and are spaced apart from the corresponding rib 14 coming from the other side of the spine 16.

Figure 3A:
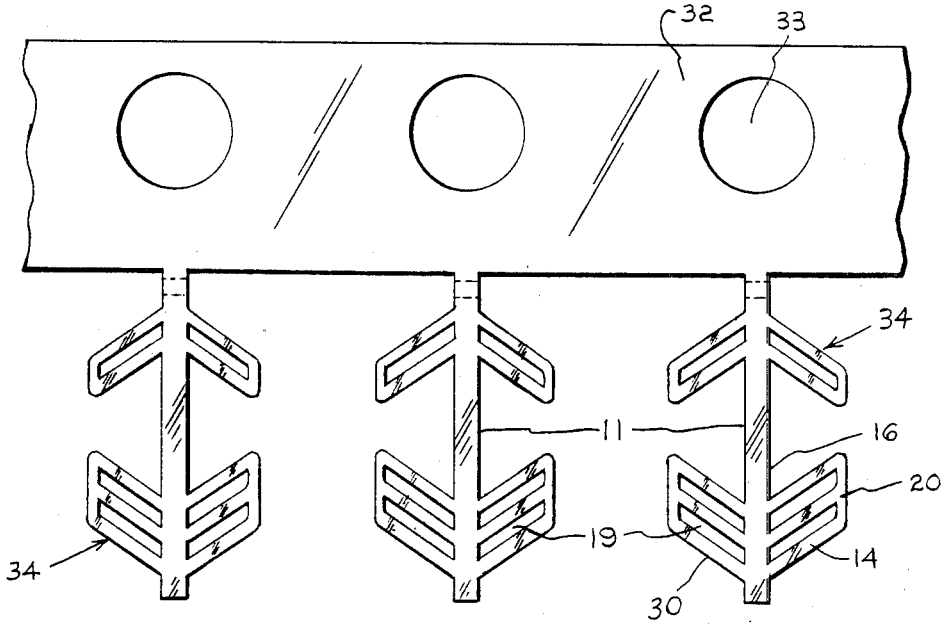
FIG. 3(A) is a perspective of the rib cage terminal on a carrier strip after being stamped from flat metal stock and before forming.
Figure 3B:
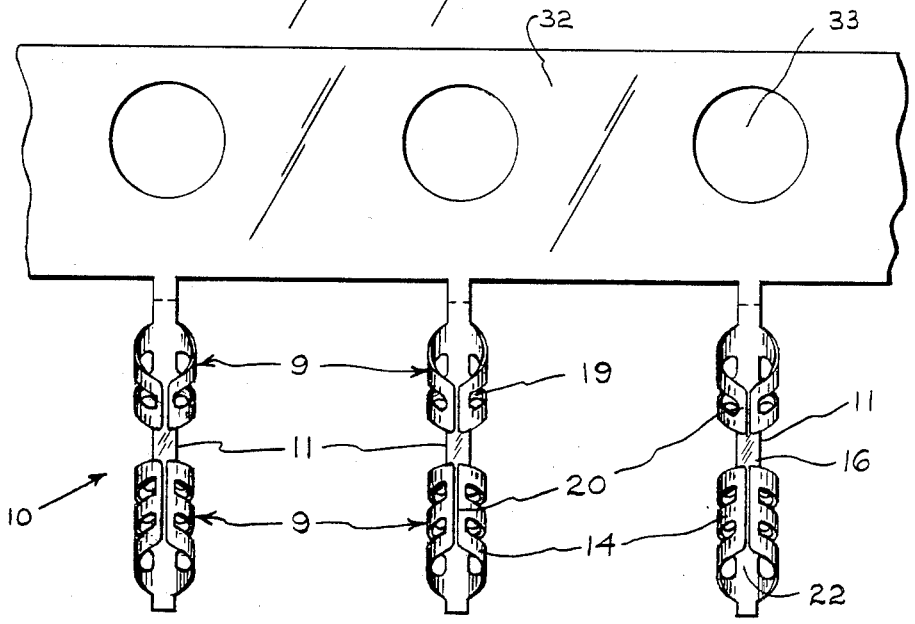
FIG. 3(B) is a perspective of the same rib cage terminal as in 3(A) after forming.

The terminals of this invention can be made from metal flat strip stock as shown in FIGS. 3(A) and 3(B). First, the carrier strip 32 has pilot holes 33 punched therein. Thereafter a stamping press punches out a design 34. A forming press turns the ribs 14 so that the configuration shown in FIG. 3(B) is achieved. The terminal is then removed from the carrier strip and the mounting tabs 18 are formed.

Figure 7:
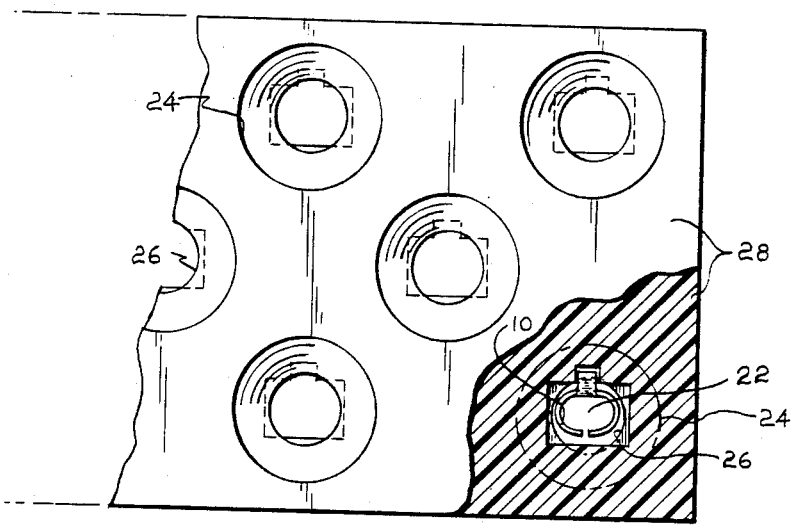
FIG. 7 is a partial sectional end view of a rib cage terminal mounted in a channel of a connector housing.
Figure 8:
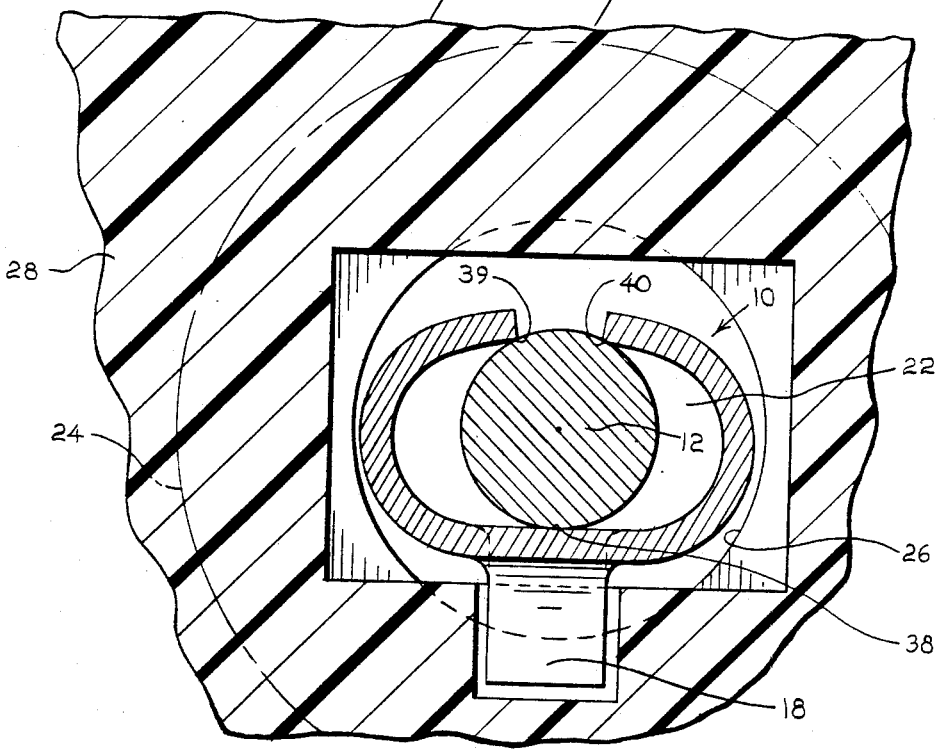
FIG. 8 is a magnified sectional end view of a rib cage terminal with inserted pin mounted in a channel of a connector housing.

As seen in FIGS. 7 and 8, the terminal is mounted within a housing into a pin channel 26. The mounting tab 18 fits into a groove within the housing and maintains the terminal 10 in a fixed position. As the pin 12 is inserted into the rib cage terminal 10 there is pressure exerted at points 38, 39 and 40. By increasing the number of ribs 14 one increases the total amount of pressure exerted on pin 12.

The metal used to form the terminal of this invention can be any one of phosphor-bronze, beryllium-copper, cupro-nickel, other copper alloys, bronze, or other metal commonly used to manufacture terminals.

Figure 4:
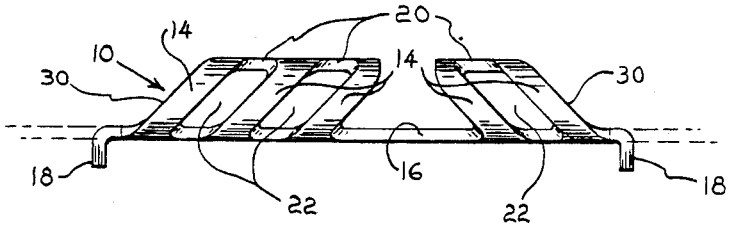
FIG. 4 is an elevation view of the rib cage terminal.

It is possible to substitute for one of the rib cages in a terminal such as shown in FIG. 4 with a single beam such as shown in FIG. 6 in order to form a second electrical termination. The second end of the spine could also have a pin, a wire wrap tail, a box connector, a pair of double beams, or other suitable electrical contact device. It is preferred to have a rib cage 9 on each side of the spine 16 so that pin contacts can be used at both ends of the terminal.

Figure 9A:
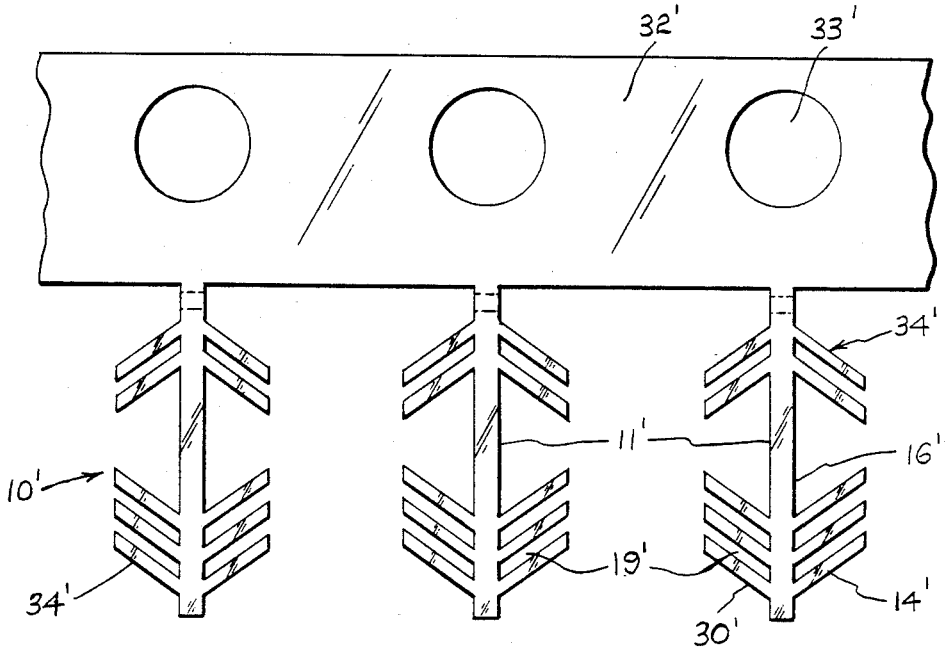
FIG. 9(A) is a perspective of an alternate rib cage terminal without a rib bridge on a carrier strip after stamping and before forming.
Figure 9B:
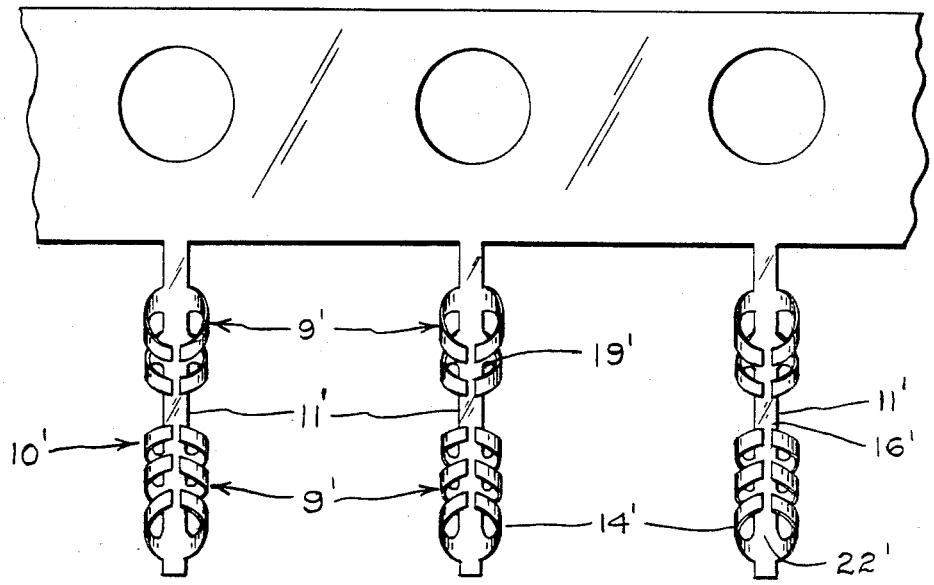
FIG. 9(B) is a perspective of the same rib cage terminal after forming.
Figure 10A:
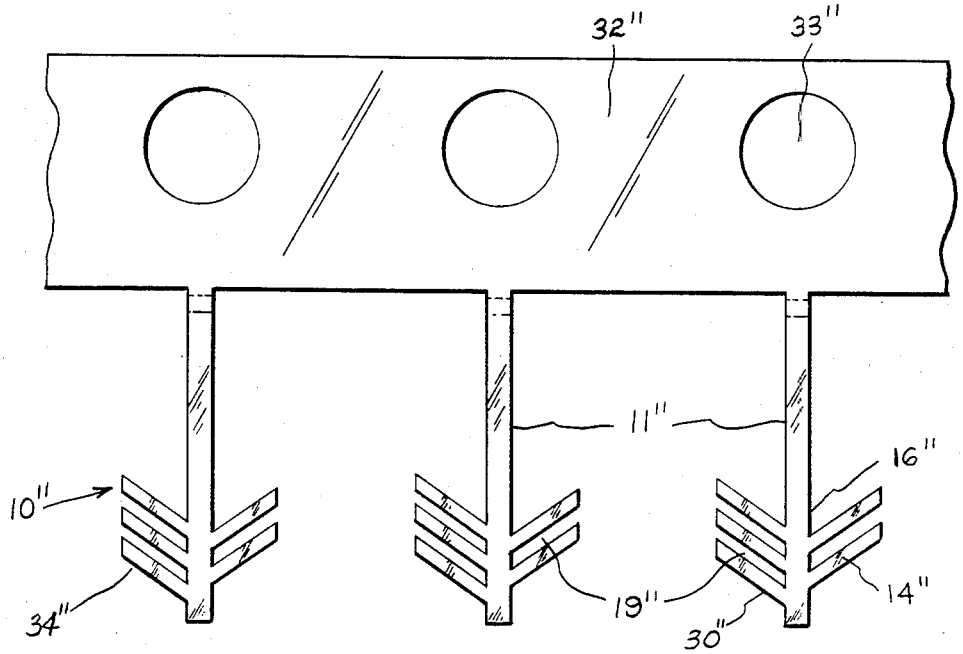
FIG. 10(A) is a perspective of an alternate rib cage terminal having offset ribs on a carrier strip after stamping and before forming.
Figure 10B:
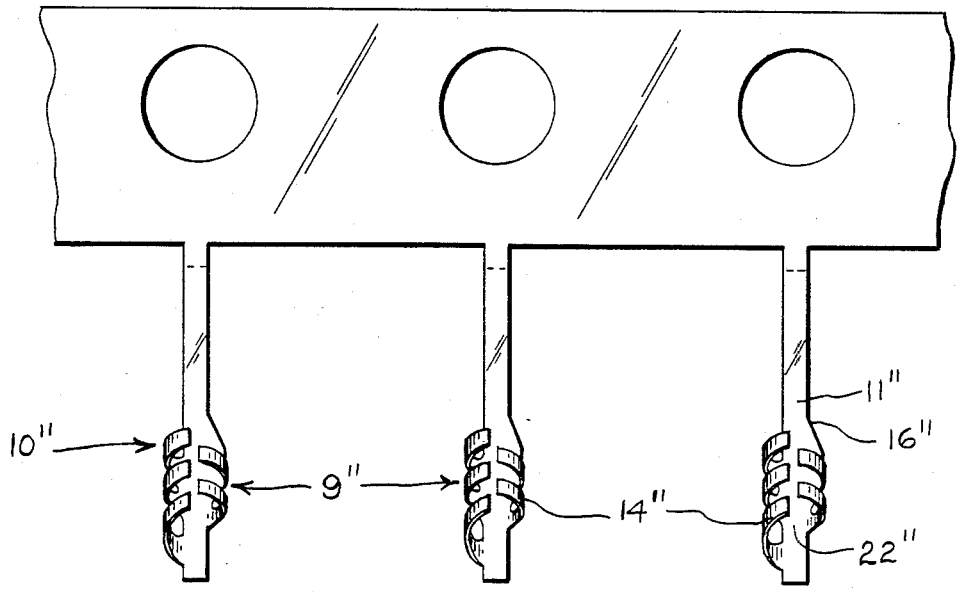
FIG. 10(B) is a perspective of the same rib cage terminal after forming.

FIGS. 9 and 10 show alternative rib cage terminals 10' and 10'' respectively. FIG. 9 shows a terminal 10' the same as in FIG. 3 except that the rib bridge 20 has been eliminated.

FIG. 10 shows a terminal 10″ which is the same as the one shown in FIG. 6 with the modification that there is no rib bridge 20 as in FIG. 6 and each rib 14″ in FIG. 10 is offset with respect to its opposing rib.

Having thus described the invention, what is claimed and desired to be secured by Letters Patent is:

1. A female electrical terminal comprising an electrically conducting rib cage mounted on a first end of an elongated planar spine and another electrically conducting body on a second end of the spine separated by a bridging mid-portion, the rib cage enclosing a pin receiving cavity created by at least two pair of ribs in the form of curved cantilevered beams angled uniformly toward the first end of the spine and attached at one end to the spine and spaced apart at its other end from a corresponding beam, each beam being at an acute angle with respect to the mid-portion of the spine, the rib cage having a diameter sufficient to accept a round or square pin inserted into the pin receiving cavity in a plane substantially parallel to the plane of the spine for electrical termination.

2. A terminal according to claim 1 having a tab on at least one end of the spine extending in a direction away from the rib cage.

3. A terminal according to claims 1 or 2 wherein another rib cage having at least two pair of ribs is on the second end of the spine.

4. A terminal according to claim 1 wherein the rib cage on the first end of the spine has three pair of ribs and the second end of the spine has a rib cage with two pair of ribs.

5. A terminal according to claim 4 having a tab at each end of the spine extending in a direction away from the rib cages.

6. A terminal according to claim 1 wherein a rib bridge connects the ends of the ribs in each rib cage.

7. A terminal according to claim 1 wherein each beam is aligned with respect to the corresponding beam.

8. A terminal according to claim 1 wherein each beam is offset with respect to its nearest correspoding beam.

9. A terminal according to claim 1 wherein the rib cage has two beams on one side and three on the other side.

* * * * *